US010596476B2

(12) United States Patent
Ostendorff et al.

(10) Patent No.: US 10,596,476 B2
(45) Date of Patent: Mar. 24, 2020

(54) TOY VEHICLE TRACK SET

(75) Inventors: Eric Ostendorff, Torrance, CA (US); Michael Nuttall, South Pasadena, CA (US)

(73) Assignee: Mattel, Inc., El Segundo, CA (US)

( * ) Notice: Subject to any disclaimer, the term of this patent is extended or adjusted under 35 U.S.C. 154(b) by 1128 days.

(21) Appl. No.: 13/597,544

(22) Filed: Aug. 29, 2012

(65) Prior Publication Data

US 2013/0231028 A1 Sep. 5, 2013

Related U.S. Application Data

(60) Provisional application No. 61/528,442, filed on Aug. 29, 2011.

(51) Int. Cl.
*A63H 18/02* (2006.01)

(52) U.S. Cl.
CPC ..... *A63H 18/028* (2013.01); *A63H 18/026* (2013.01)

(58) Field of Classification Search
CPC ..... A63H 18/28; A63H 18/02; A63H 18/06; A63H 18/00; A63H 18/04; A63H 17/14
See application file for complete search history.

(56) References Cited

U.S. PATENT DOCUMENTS

| | | | | |
|---|---|---|---|---|
| 3,209,491 | A | 10/1965 | Roeper | |
| 3,590,524 | A | 7/1971 | Beny et al. | |
| 3,641,704 | A | 2/1972 | Sims et al. | |
| 3,734,500 | A * | 5/1973 | Cooper | 273/442 |
| 4,251,949 | A | 2/1981 | Buck et al. | |
| 4,516,953 | A | 5/1985 | Hippely et al. | |
| 4,571,204 | A | 2/1986 | Wang | |
| 5,299,969 | A | 4/1994 | Zaruba | |
| 5,899,789 | A | 5/1999 | Rehkemper et al. | |
| 6,000,992 | A | 12/1999 | Lambert | |
| 6,089,951 | A | 7/2000 | Ostendorff | |
| 6,241,573 | B1 | 6/2001 | Ostendorff et al. | |
| 6,358,112 | B1 | 3/2002 | Lambert et al. | |
| 6,478,654 | B1 * | 11/2002 | Rehkemper et al. | 446/431 |
| 6,676,480 | B2 | 1/2004 | Sheltman | |
| 6,793,554 | B1 | 9/2004 | Newbold | |
| 6,913,508 | B2 | 7/2005 | Hornsby et al. | |
| 7,628,673 | B2 | 12/2009 | Bedford et al. | |
| 7,766,720 | B2 | 8/2010 | Ostendorff | |
| 7,794,301 | B2 | 9/2010 | Ostendorff et al. | |
| 7,857,679 | B2 | 12/2010 | O'Connor et al. | |
| 7,901,266 | B2 | 3/2011 | Ostendorff | |
| 7,955,158 | B2 | 6/2011 | Filoseta et al. | |
| 7,963,821 | B2 | 6/2011 | Ostendorff | |
| 2005/0287919 | A1 | 12/2005 | Sheltman et al. | |
| 2007/0197127 | A1 * | 8/2007 | Ostendorff et al. | 446/433 |

* cited by examiner

*Primary Examiner* — Melba Bumgarner
*Assistant Examiner* — Amir A Klayman
(74) *Attorney, Agent, or Firm* — Edell, Shapiro & Finnan, LLC

(57) ABSTRACT

A track set for toy vehicles is provided, the track set having: a first track circuit having a loop section and a figure-8 track circuit; a second track circuit having a loop section and figure-8 track circuit, wherein the figure-8 track circuits are overlaid on each other to provide multiple intersections between each figure-8 track circuit, wherein the toy vehicles travelling on the figure-8 track circuits can crash into each other as they travel along the figure-8 track circuits; and a mechanism for propelling the vehicles along the first track circuit and the second track circuit.

15 Claims, 10 Drawing Sheets

TOY VEHICLE TRACK SET

CROSS REFERENCE TO RELATED APPLICATIONS

This application claims the benefit of U.S. Provisional Patent application No. 61/528,442, filed Aug. 29, 2011, the contents of which are incorporated herein by reference thereto.

BACKGROUND

Play sets for toy vehicles are popular toys which are known to provide entertainment and excitement to a user. These play sets typically include a track configuration intended to guide a propelled toy vehicle, such as a 1/64 scale die-cast metal toy vehicle, through a course. The track configurations include closed-loop continuous track arrangements and open-end arrangements. Toy vehicles are placed on these play set tracks and propelled across the configuration by hand or by an external propulsion means.

To bring increased entertainment and excitement to play sets, track configurations may include features such as intersecting tracks, loop segments, and other types of track configurations.

Accordingly, a play set for toy vehicles that can propel multiple toy vehicles along various track segments, which sometimes interact with each other and sometimes are separate from each other is desired.

BRIEF SUMMARY OF INVENTION

In one embodiment, a track set for toy vehicles is provided, the track set having: a first track circuit having a loop section and a figure-8 track circuit; a second track circuit having a loop section and figure-8 track circuit, wherein the figure-8 track circuits are overlaid on each other to provide multiple intersections between each figure-8 track circuit, wherein the toy vehicles travelling on the figure-8 track circuits can crash into each other as they travel along the figure-8 track circuits; and a mechanism for propelling the vehicles along the first track circuit and the second track circuit.

In another exemplary embodiment, a track set for toy vehicles is provided, the track set having: a first track circuit having a loop section and a closed track circuit; a second track circuit having a loop section and a closed track circuit, wherein the closed track circuits are overlaid on each other to provide multiple intersections between each closed track circuit, wherein the toy vehicles travelling on the closed track circuits can crash into each other as they travel along the closed track circuits; and at least one booster for propelling the vehicles along the first track circuit and the second track circuit.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
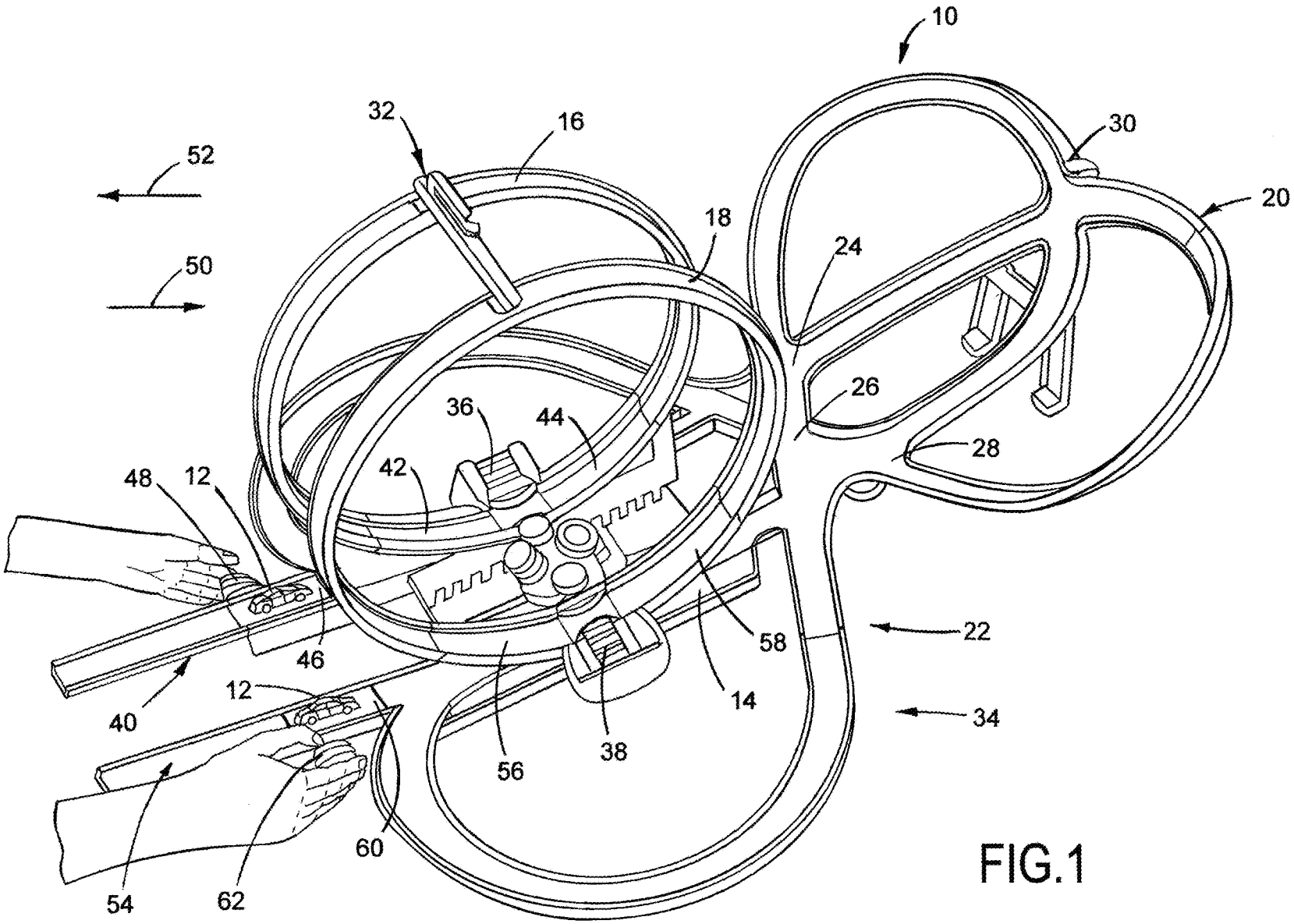
FIG. 1 is a perspective view of a play set according to an embodiment of the invention in a first configuration.

FIG. 1 shows an exemplary play set or track set 10 for toy vehicles or objects 12 according to one non-limiting embodiment of the present invention. The play set 10 includes a base 14, two independent loop sections 16 and 18 mounted to the base and two independent figure-8 track circuits 20 and 22. The figure-8 track circuits 20 and 22 each being overlaid on each other at intersections 24, 26, 28 and 30, resulting in multiple intersections or crossings points between each figure-8 track circuit where the toy vehicles or objects 12 can crash into each other as they travel along the track paths of the two independent figure-8 track circuits 20 and 22. It is, of course, understood that exemplary embodiments of the present invention contemplate various track circuit configurations and the track circuits 20 and 22 of present invention can have other configurations other than figure-8s.

As referred to herein two track circuits are provided namely, a first track circuit 32 comprising loop section 16 and figure-8 track circuit 20 and a second track circuit 34 comprising loop section 18 and figure-8 track circuit 22.

Each track circuit has a mechanism or motorized booster to provide a propelling force to the vehicles as they enter the track circuit. As illustrated, first track circuit 32 has a mechanism or booster 36 and the second track circuit 34 has a mechanism or booster 38. The boosters are mounted to the base and impart a propelling force to the toy vehicles 12 when they are travelling in the loop sections.

As is known in the related arts the booster is configured to accelerate the toy vehicles along the tracks of the toy. In one non-limiting embodiment, the booster is powered by a motor that is coupled to one or more booster wheels that are each arranged in one of the track paths. The booster wheels may be made of rubber (PVC), foam, or other materials known in the art. In one embodiment, a single wheel may be employed or two oppositely disposed wheels are employed. The motor, which may be a 6-volt electric motor, rotates the booster wheels at high speeds such that vehicles travel along the track path contact the rotating wheels and are propelled forward thereby at higher speeds to ensure the return of the vehicles to the inlet of the booster wheels after one of the track paths is traversed. As such, vehicles traveling through the track set may traverse along a respective loop, figure 8 circuit or track circuit as long as the booster is operated or until the vehicle is knocked off of the track due to a collision or other mishap.

Non-limiting examples of boosters are found in the following U.S. Pat. Nos. 7,955,158; 6,793,554; 3,641,704; and 3,590,524 the contents each of which are incorporated herein by reference thereto.

Each loop section receives a toy vehicle or object 12 from an inlet track and each loop section has a freely pivoting arc-shaped trap door that is part of the loop and an exit door, which in one embodiment is also a portion of the loop and is opened by a user of the play set by activating a lever. In addition, the lever will also provide a means for introducing a toy vehicle from the inlet track into a track circuit.

As illustrated, loop section 16 has an inlet track 40, a freely pivoting arc-shaped or other suitably shaped trap door 42 and an exit door 44 (arc-shaped or otherwise), which also comprises a portion of the loop section 16. As mentioned above, the exit door 44 and a pivotal portion 46 of the inlet track are moved between first and second positions through movement of a lever 48 in the direction of arrows 50 and 52. In one exemplary embodiment, the lever 48 is coupled to exit door 44 and pivotal portion 46 via a linkage or any other suitable means or mechanism such that movement of the lever 48 in a particular direction causes movement of either exit door 44 or pivotal portion 46.

Similarly, loop section 18 has an inlet track 54, a freely pivoting arc-shaped trap door or other suitably shaped trap door 56 and an exit door 58 (arc-shaped or otherwise), which also comprises a portion of the loop section 18. As mentioned above, the exit door 58 and a pivotal portion 60 of the inlet track are moved between first and second positions through movement of a lever 62 in the direction of arrows 50 and 52. In one exemplary embodiment, the lever 62 is coupled to exit door 58 and pivotal portion 60 via a linkage or any other suitable means or mechanism such that movement of the lever 62 in a particular direction causes movement of either exit door 58 or pivotal portion 60.

Figure 2:
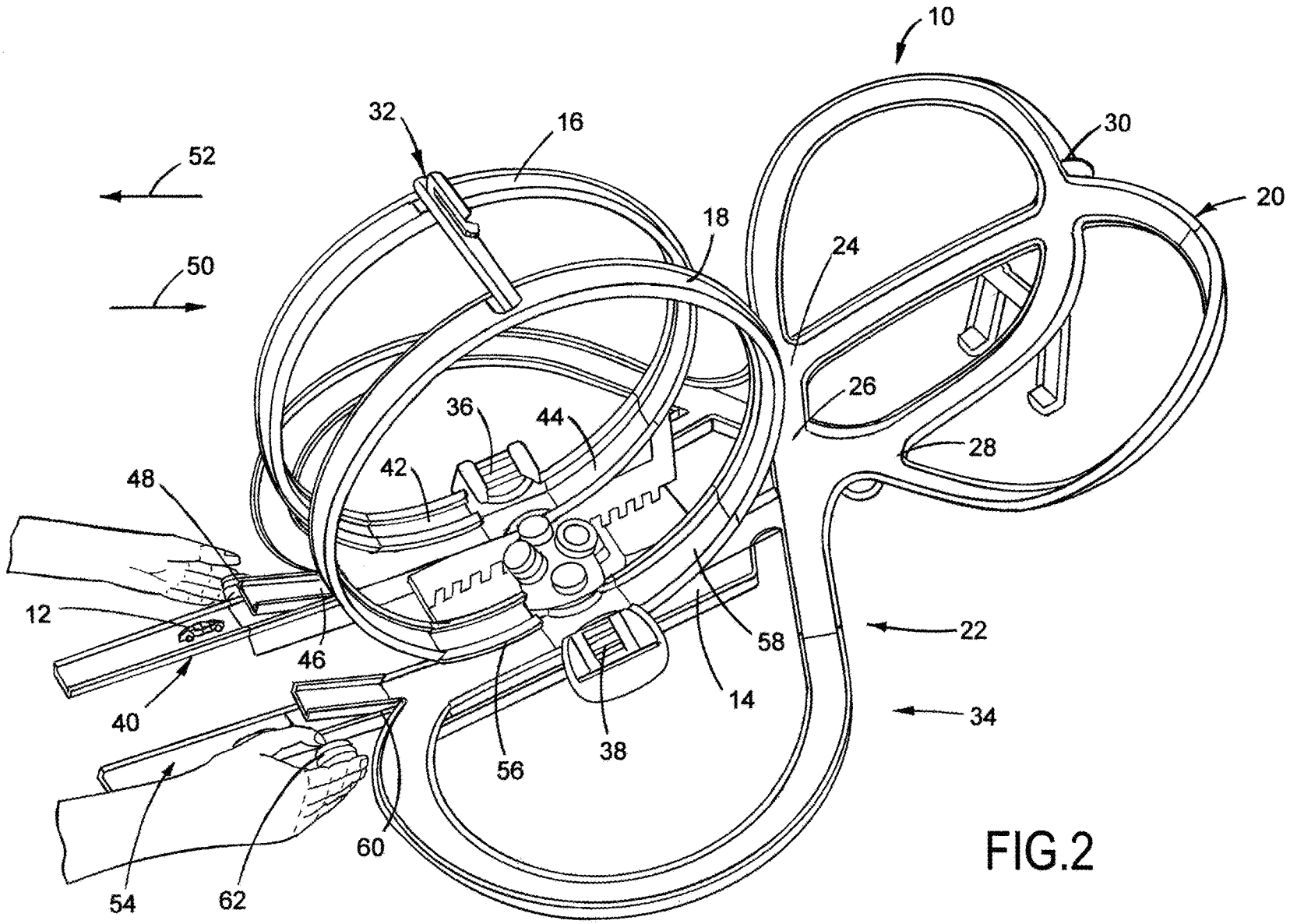
FIG. 2 is a perspective view of the play set according of FIG. 1 in a second configuration.

In order to introduce vehicles into a loop of a respective track circuit and referring in particular to FIG. 2, a lever (48, 62) is moved in the direction of arrow 52 which pivots a pivotal portion (46, 60) upward with respect to its inlet track such that the toy vehicle or object 12 on it will roll forward due to an inclination of the pivotal portion of the incoming track and gravity acting on the vehicle so that the toy vehicle or object will pass under the associated freely pivoting arc-shaped trap door (42, 56) pivot it up and enter the loop and be propelled by its associated booster. Thereafter, the toy vehicle or object will continue to travel around in the loop since the associated freely pivoting arc-shaped trap door pivots back down to a first position (FIG. 1).

Figure 3:
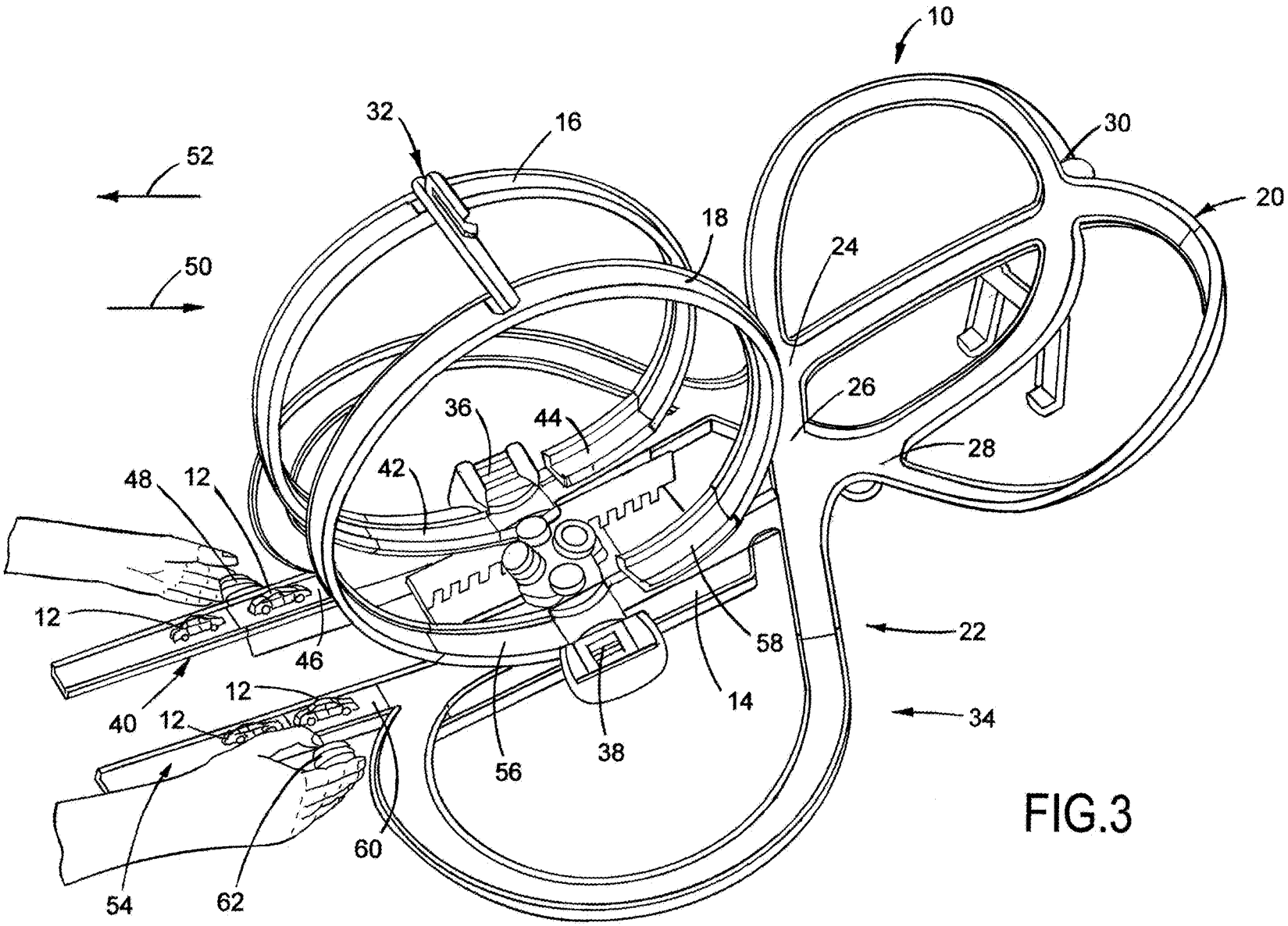
FIG. 3 is a perspective view of the play set according of FIGS. 1-2 in a third configuration.
Figure 4A:
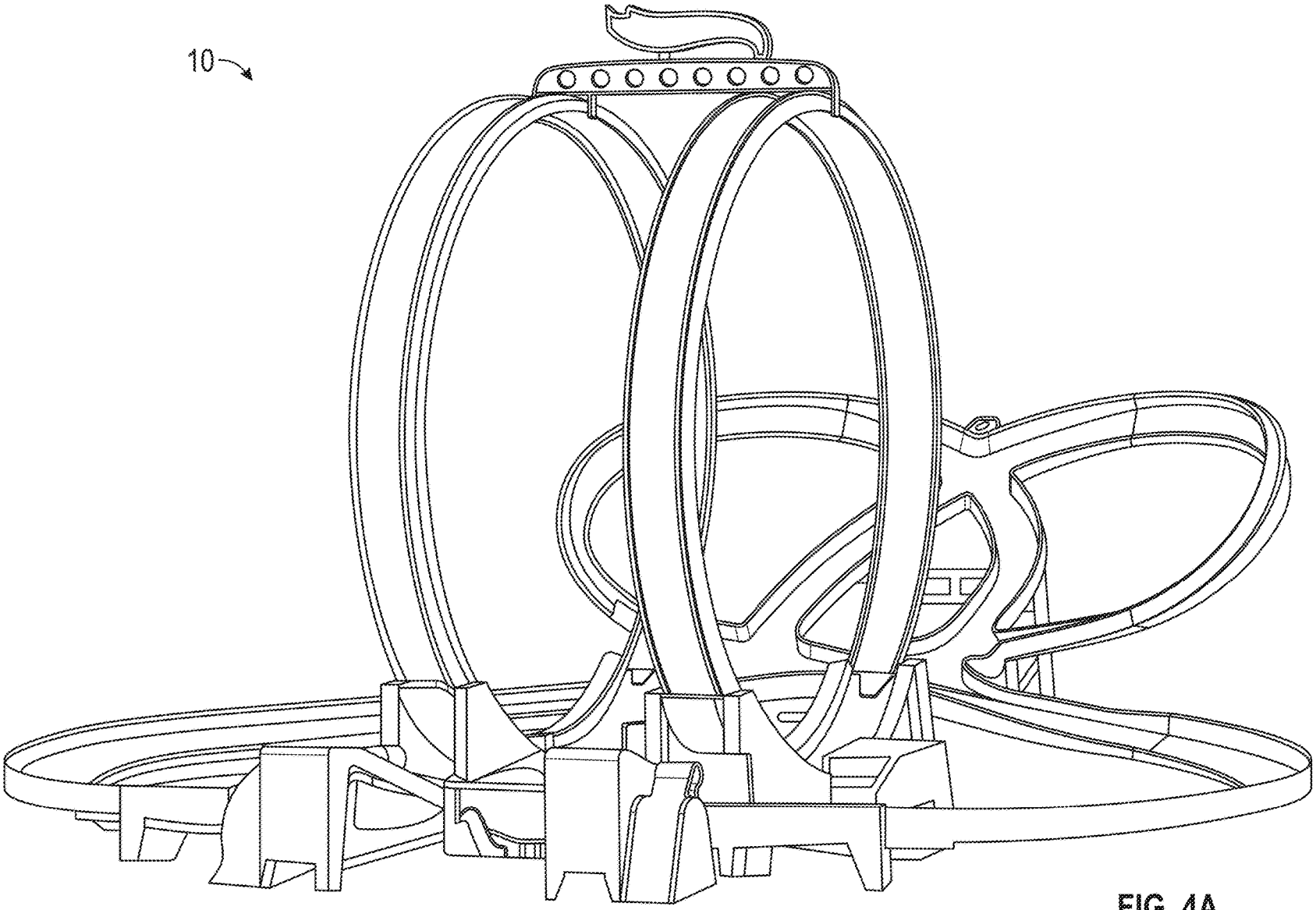
FIGS. 4A-7 provide additional various views of exemplary embodiments of the present invention.
Figure 4B:
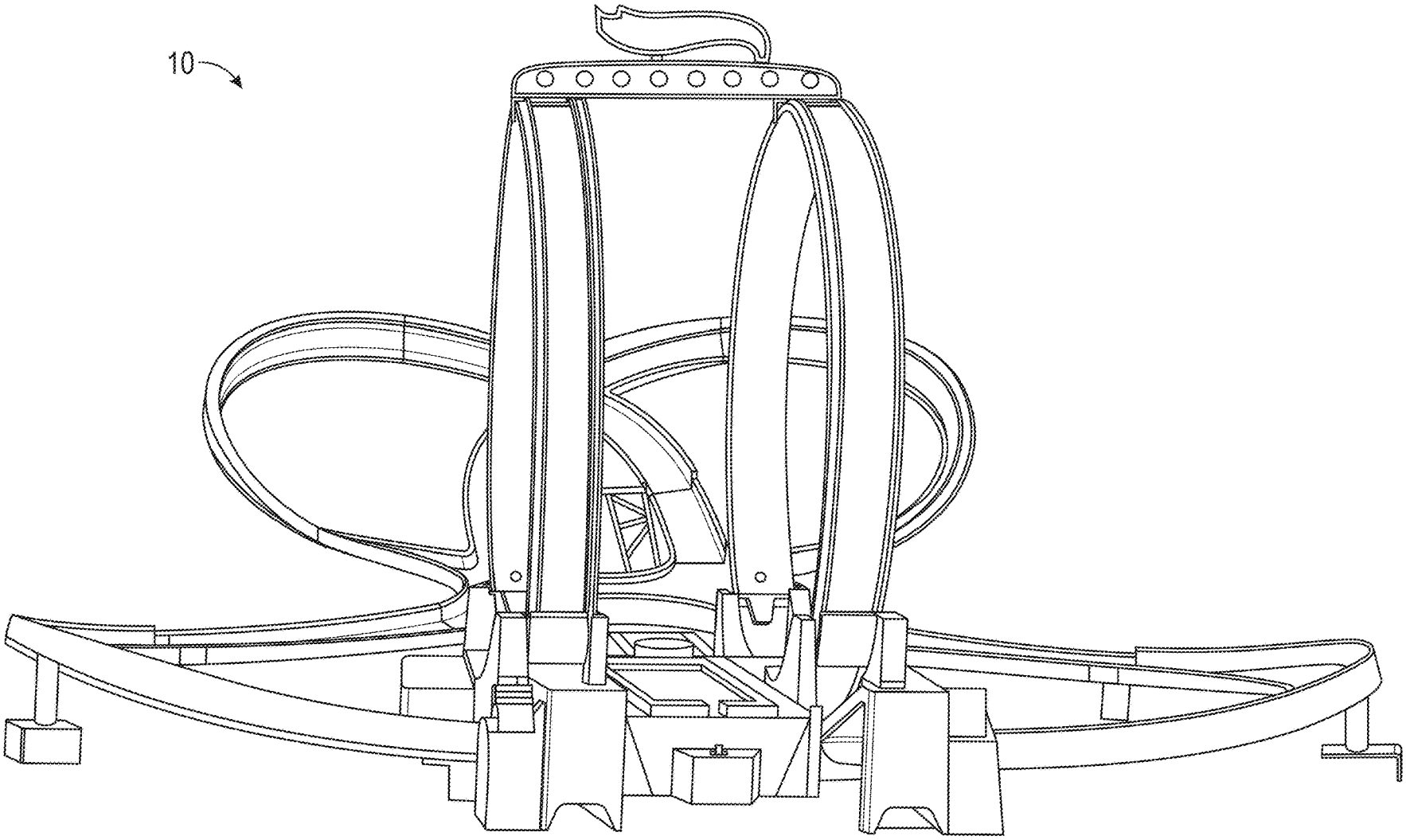
Figure 5A:
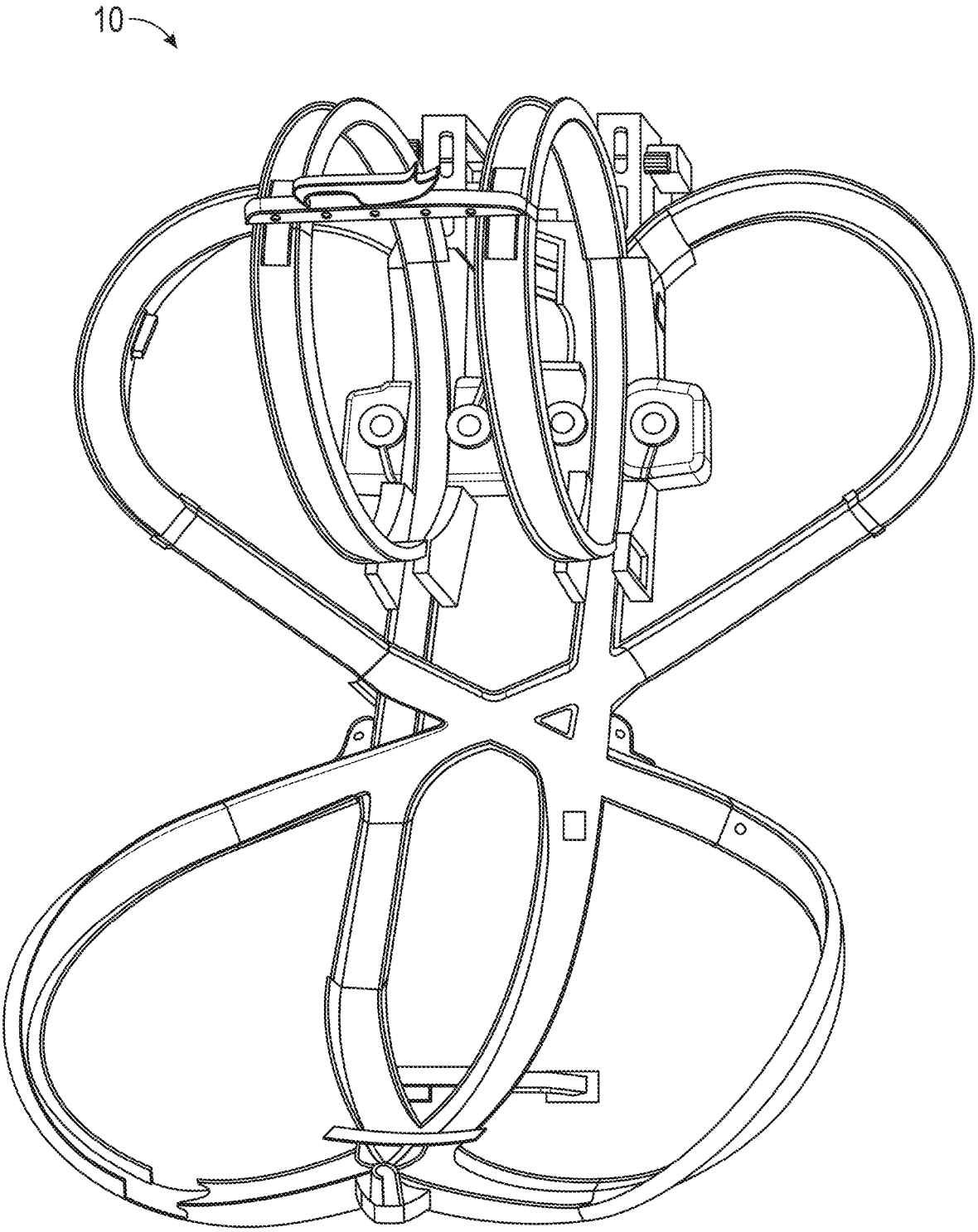
Figure 5B:
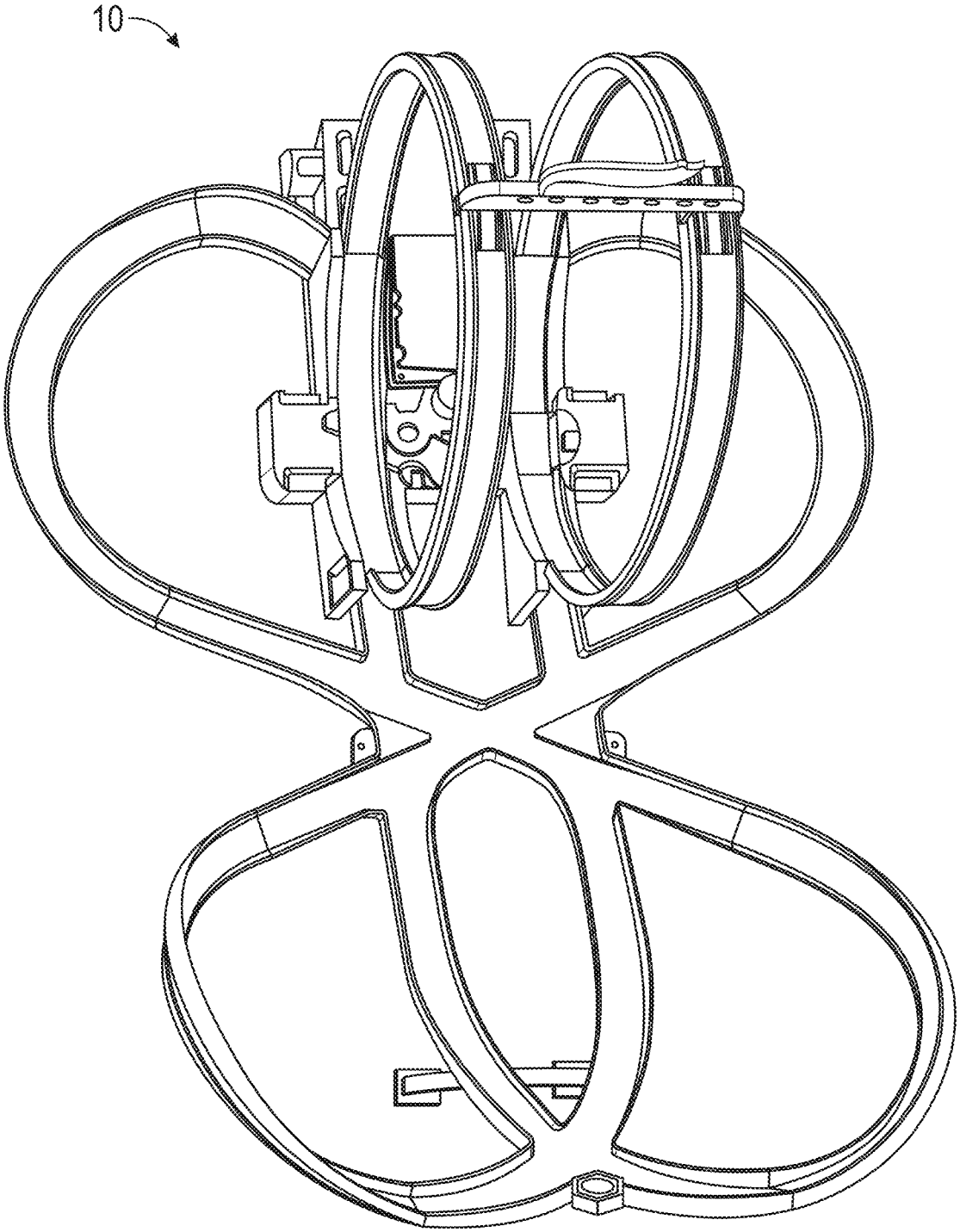
Figure 6A:
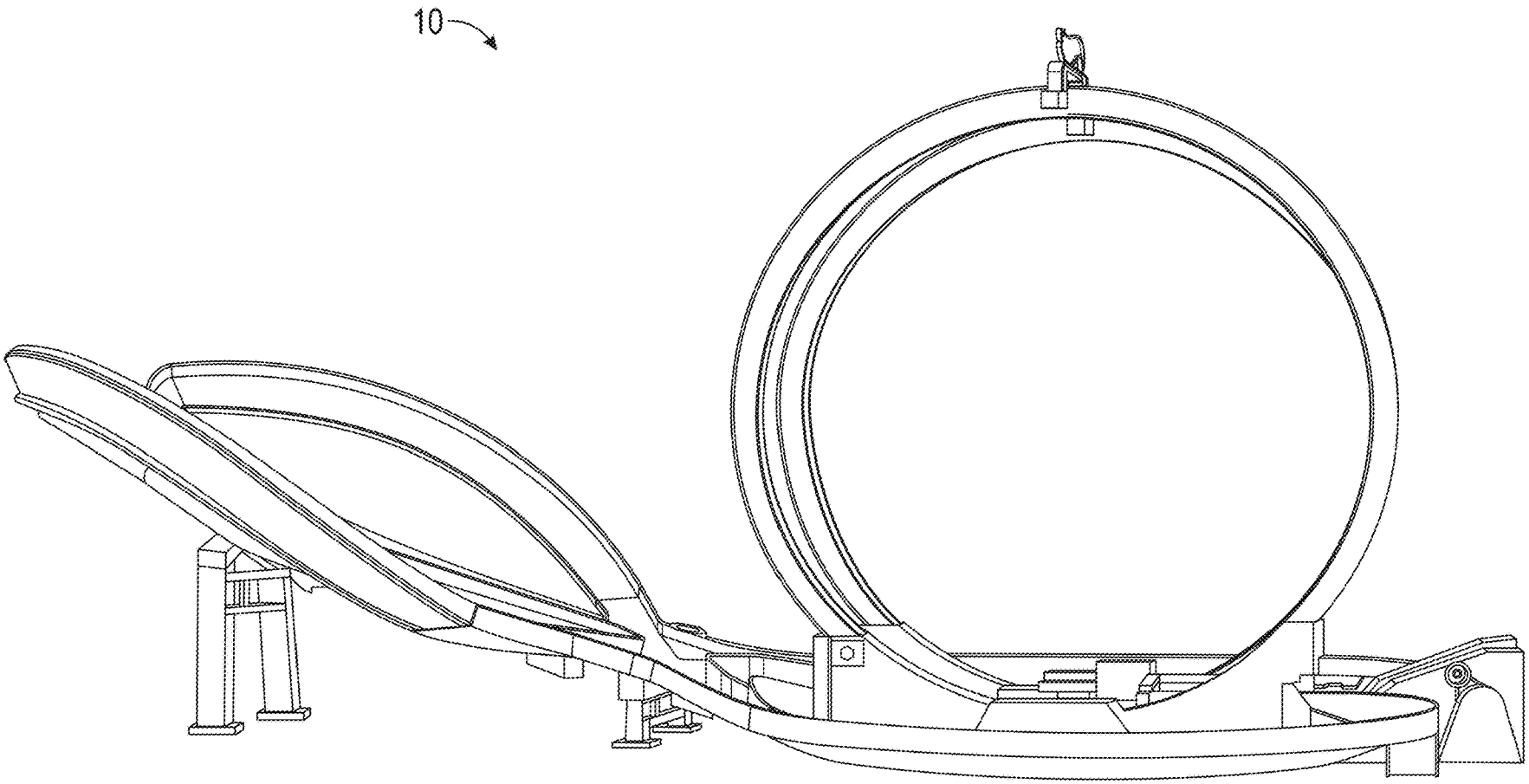
Figure 6B:
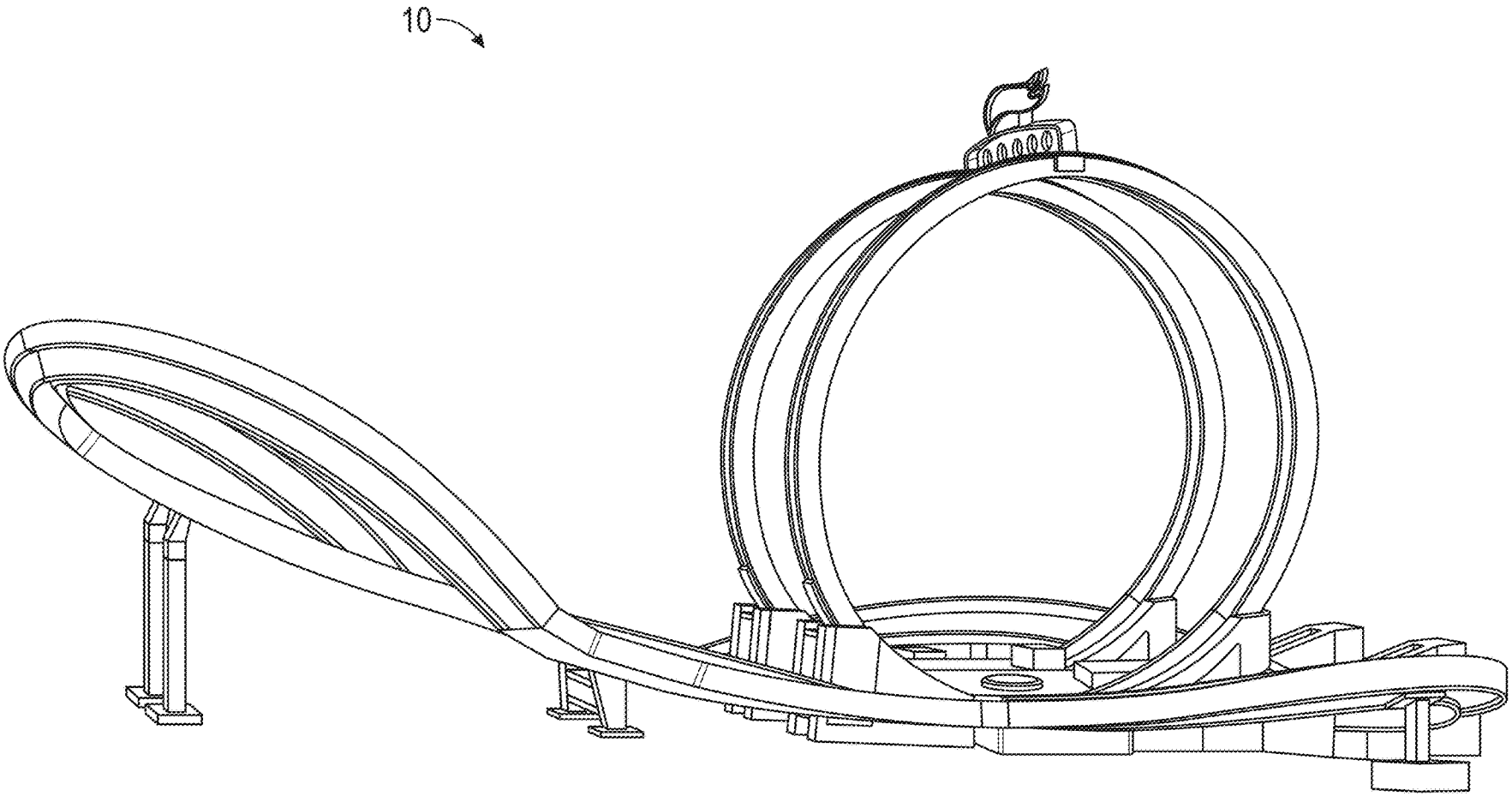
Figure 7:
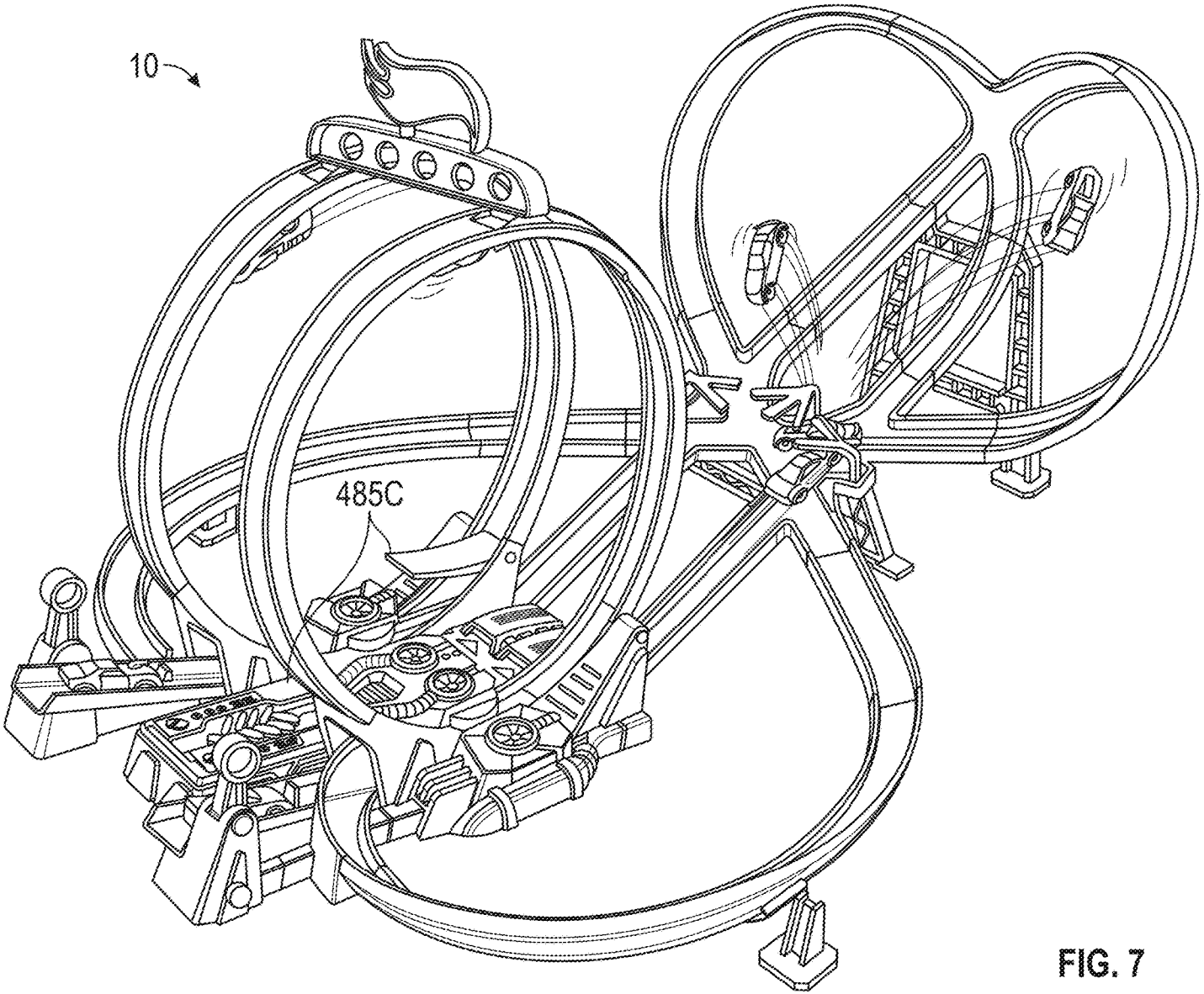

In order, to release the vehicle or object 12 from the loop its associated lever (48, 62) is manipulated in the direction of arrow 50 such that the loop's exit door moves from a first position FIGS. 1 and 2 to a second open position FIG. 3, wherein the vehicle may now be propelled into the associated figure-8 or other equivalent track circuit 20 by traveling under the exit door (44, 58) and onto the associated figure-8 track circuit or track circuit.

As mentioned above, the figure-8 or other equivalent track circuits are overlaid on each other at intersections 24, 26, 28 and 30, resulting in multiple intersections or crossings point between each figure-8 track circuit where the toy vehicles or objects 12 can crash into each other as they travel along the track paths of the two independent figure-8 track circuits 20 and 22.

Each figure 8 track circuit rejoins or feeds into its associated loop section directing the toy vehicle back under its associated freely pivoting arc-shaped trap door 42, 56, pivoting it up, and then traveling into its associated loop section and is once again propelled by its respective booster. At this point, the vehicle may continue back into the figure 8 track circuit or be redirected back into the loop section depending on the position of the associated lever (48, 62) and exit door (44, 58). In other words, once the toy vehicles enter the loop section either from the figure 8 track circuit or pivotal portions 46 and 60 of the inlet tracks, they remain in the loop sections unless the exit door (44, 58) is in the second position such that the toy vehicles can exit the loop section by traveling under the exit door (44, 58) when it is in the second position and thus travel onto the figure 8 track circuit.

Accordingly and as illustrated, each lever has a first position wherein neither the exit door or inlet pivotal portion is moved from its first position (FIG. 1); a second position wherein the lever is moved in the direction of arrow 52 and inlet pivotal portion is moved from its first position to a second position while the exit door remains in the first position (FIG. 2); and a third position wherein the lever is moved in the direction of arrow 50 and the exit door is moved from its first position to a second position while the inlet pivotal portion remains in the first position (FIG. 3). In one non-limiting embodiment, the lever may be spring biased into the first position and similarly, the exit door and inlet pivotal portion may also be spring biased into the first position or simply return thereto due to gravity.

In a power loop configuration, the levers 48 and 62 are not moved in the direction of arrow 50 and accordingly, the cars or vehicles can loop continuously until an exit door is opened by the user activating the lever in the directions of arrow 52. The vehicles then return to the booster at ground level through the freely pivoting arc-shaped trap door which is part of the loop.

An end of the track set opposite to the loop sections is elevated so that after exiting the loop section, the vehicles, cars or objects travel uphill through the multiple intersections and if they do not collide with other vehicles they perform a U-turn, and travel back downhill through the intersections, and again if they do not collide with another vehicle, they travel around another curve to re-enter the booster through the trap door.

In addition and as mentioned above, a downhill feeder lane or inlet track (40, 54) merges into the trap door entrance to the loop section. In one embodiment, several cars or vehicles can be placed on the feeder lane or inlet track and can be individually released to enter the loop section using the release lever.

Each motorized booster will be strong enough to sustain several vehicles simultaneously, so when two users are involved, there are many vehicles in high-speed motion on the set. The vehicles which crash impact at high speeds will tend to eject themselves from the intersections, clearing off of the track set to allow continuous action.

FIGS. 4A-7 provide additional various views of exemplary embodiments of the present invention.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A track set for toy vehicles, comprising:

a first track circuit having a first loop section and a first figure-8 track circuit;

a second track circuit having a second loop section and second figure-8 track circuit, wherein the first and second figure-8 track circuits are overlaid on each other to provide multiple intersections between each of the figure-8 track circuits, wherein the toy vehicles travelling on the first and second figure-8 track circuits can crash into each other as they travel along the first and second figure-8 track circuits; and a mechanism for propelling the toy vehicles along the first track circuit and the second track circuit, wherein:

the first loop section receives the toy vehicles from a first inlet track that has a movable portion that is coupled, via a linkage, to a first lever;

the second loop section receives the toy vehicles from a second inlet track;

each loop section has a pivoting arc-shaped trap door that is part of the loop section and a pivoting exit door, which is also a portion of the loop section; and movement of the first lever tilts the movable portion from a first position where the toy vehicles are retained on the first inlet track to a second position where the toy vehicles are propelled via gravity towards the pivoting arc-shaped trap door of the first loop section and enter the first loop section.

2. The track set as in claim 1, wherein the pivoting exit door of the first loop section is also coupled to the first lever via the linkage, wherein the movement of the first lever also moves the pivoting exit door of the first loop section from a first exit door position where the toy vehicles are retained in the first loop section to a second exit door position where the toy vehicles are free to exit the first loop section.

3. The track set as in claim 2, wherein the first lever has:

a first lever position wherein neither the pivoting exit door of the first loop section nor the movable portion of the first inlet track is moved from its first position;

a second lever position wherein the first lever is moved in a first direction and the movable portion of the first inlet track is moved from its first position to its second position while the pivoting exit door of the first loop section remains in the first position; and a third lever position wherein the first lever is moved in a second direction opposite to the first direction and the pivoting exit door of the first loop section is moved from its first position to its second position while the movable portion of the first inlet track remains in its first position.

4. The track set as in claim 3, wherein the first lever is spring-biased towards the first lever position.

5. The track set as in claim 1, wherein the mechanism for propelling the toy vehicles along the first track circuit and the second track circuit comprises:

a first motorized booster configured to provide a propelling force to toy vehicles as they travel on the first track circuit;

a second motorized booster configured to provide a propelling force to toy vehicles as they travel on the second track circuit; and wherein the pivoting arc-shaped trap door of the first loop section is disposed on one side of the first motorized booster and the pivoting exit door of the first loop section is disposed on an opposite side of the first motorized booster, and the pivoting arc-shaped trap door of the second loop section is disposed on one side of the second motorized booster and the pivoting exit door of the second loop section is disposed on an opposite side of the second motorized booster.

6. The track set as in claim 1, wherein each pivoting arc-shaped trap door is disposed on one side of the mechanism for propelling the toy vehicles and each exit door is disposed on an opposite side of the mechanism for propelling the toy vehicles.

7. The track set as in claim 1, wherein each of the figure-8 track circuits rejoins its associated loop section under its associated pivoting arc-shaped trap door.

8. The track set as in claim 1, wherein a first end of the track set opposite to the first and second loop sections is elevated so that after exiting either of the first and second loop section, the toy vehicles travel uphill in a first direction, perform a U-turn, and travel back downhill in a second direction and re-enter the first and second loop sections through one of the pivoting arc-shaped trap doors.

9. The track set as in claim 1, wherein the mechanism for propelling the toy vehicles along the first track circuit and the second track circuit comprises:

a first booster, including an electric motor, configured to provide a propelling force to the toy vehicles as they travel on the first track circuit; and a second booster, including an electric motor, configured to provide a propelling force to the toy vehicles as they travel on the second track circuit.

10. The track set as in claim 1, wherein the pivoting exit door of the first loop section is moved from a first position where the toy vehicles are retained in the first loop section to a second position where the toy vehicles are free to exit the first loop section by the first lever.

11. A track set for toy vehicles, comprising:

a first track circuit having a first loop section and a closed track circuit;

a second track circuit having a second loop section and a closed track circuit, wherein:

the closed track circuits are overlaid on each other to provide multiple intersections between each closed track circuit, wherein the toy vehicles travelling on the closed track circuits return back to the first and second loop sections after they travel along the closed track circuits; and the first loop section receives the toy vehicles from a first inlet track, the second loop section receives the toy vehicles from a second inlet track, and each loop section has a pivoting arc-shaped trap door that is part of the loop section and an exit door, which is also a portion of the loop section; and the first inlet track has a movable portion that is coupled, via a linkage, to a first lever, wherein movement of the first lever tilts the movable portion from a first position where the toy vehicles are retained on the first inlet track to a second position where the toy vehicles are propelled via gravity towards the pivoting arc-shaped trap door of the first loop section and enter the first loop section;

at least one booster, including an electric motor, for propelling the toy vehicles along the first track circuit and the second track circuit.

12. The track set as in claim 11, wherein the exit door of the first loop section is also coupled to the first lever via the linkage, the first lever being movable from a first lever position where the toy vehicles are retained in the first loop section by the exit door of the first loop section to a second lever position where the toy vehicles are free to exit the first loop section by the exit door of the first loop section.

13. The track set as in claim 11, wherein a first end of the track set opposite to the first and second loop sections is elevated so that after exiting the loop sections, the toy vehicles travel uphill in a first direction, perform a U-turn, and travel back downhill in a second direction and re-enter the loop sections through one of the pivoting arc-shaped trap doors.

14. The track set as in claim 13, wherein each closed track circuit is configured as a figure-8.

15. The track set as in claim 11, wherein the pivoting arc-shaped trap door of the first loop section is disposed on one side of the at least one booster and the exit door of the first loop section is disposed on an opposite side of the at least one booster.

* * * * *